US005835114A

United States Patent [19]

Nagata et al.

[11] Patent Number: 5,835,114

[45] Date of Patent: Nov. 10, 1998

[54] IMAGE PRINTING APPARATUS

[75] Inventors: Masaya Nagata; Masayoshi Tsunezawa; Masaaki Ozaki, all of Nara; Kaoru Higuchi, Tenri, all of Japan

[73] Assignee: Sharp Kabushiki Kaisha, Osaka, Japan

[21] Appl. No.: 759,679

[22] Filed: Dec. 6, 1996

[30] Foreign Application Priority Data

Dec. 8, 1995 [JP] Japan ..... 7-320877

[51] Int. Cl.[6] ..... B41J 2/06; B41J 2/21

[52] U.S. Cl. ..... 347/55; 347/83

[58] Field of Search ..... 347/55, 54, 20, 347/1, 120, 123, 83

[56] References Cited

U.S. PATENT DOCUMENTS

| | | | |
|---|---|---|---|
| 4,647,945 | 3/1987 | Andeen et al. | 346/1.1 |
| 4,825,229 | 4/1989 | Matsumoto et al. | 347/83 |
| 4,908,638 | 3/1990 | Albosta et al. | 346/140 R |
| 5,032,850 | 7/1991 | Andeen et al. | 347/83 |
| 5,113,198 | 5/1992 | Nishikawa et al. | 346/1.1 |

FOREIGN PATENT DOCUMENTS

| | | |
|---|---|---|
| 212792 | 3/1987 | European Pat. Off. . |
| 0730963 | 9/1996 | European Pat. Off. . |
| 56-2020 | 1/1981 | Japan . |
| 57-1771 | 1/1982 | Japan . |
| 59-133064 | 7/1984 | Japan . |
| 61-106261 | 5/1986 | Japan . |
| 64-82961 | 3/1989 | Japan . |

*Primary Examiner*—Benjamin R. Fuller
*Assistant Examiner*—Juanita Stephens

[57] ABSTRACT

An image printing apparatus for forming an image on a printing medium includes: a printing head including two ink chambers and a shutter; a heater provided under the two ink chambers; a charging electrode provided between the printing medium and the two ink chambers; a back electrode provided on a side of the printing medium which is opposite a side on which the image is formed; a controller associated with the shutter, the heater and the charging electrode.

21 Claims, 17 Drawing Sheets

Printing starts
Printing ends
Head controlling signal
Printing in progress
A
E'

Heating device 2b
B

Charging electrode 4

Threshold value
Amount of vaporized ink
C
F

Printing start/end signal
D
E

Electric field shutter 8
B'
D'
E'

Back electrode 11

Heating device 2a

Head operation starts
Head operation ends
Head controlling signal
Head operation in progress
A Tg
Heating device
B
G
H Charging electrode Threshold value
Amount of vaporized ink
C
F Printing starts
Printing ends
Printing start/end signal
D
E Electric field shutter
B'
D'
E'

Back electrode

Printing starts
Printing ends
Head controlling signal
Printing in progress
A
E'

Heating device 2
B

Charging electrode

Threshold value
Amount of vaporized ink
C
F

Printing start/end signal
D
E

Electric field shutter 81
B'
D'
E'

Electric field shutter 82

Electric field shutter 83

Back electrode

Printing starts
Printing ends

Head controlling signal
Printing in progress
A
E'

Heating device 21
B

Heating device 22

Heating device 23

Charging electrode

Threshold value
Amount of vaporized ink
C
F

Printing start/end signal
D
E

Electric field shutter 81
B'
D'
E'

Electric field shutter 82

Electric field shutter 83

Back electrode

IMAGE PRINTING APPARATUS

BACKGROUND OF THE INVENTION

1. Field of the Invention

The present invention relates to an image printing apparatus such as a copier, a facsimile machine, a printer, etc., and more particularly, to a printing head portion of an image printing apparatus which forms an image by intermittently discharging sublimated or vaporized ink and selectively having the ink adhere onto or permeate into a printing medium.

2. Description of the Related Art

Conventional discharge-type image printing apparatuses include an ink-jet image printing apparatus and an electrostatic image printing apparatus. The ink-jet method uses a piezoelectric element or the like which receives electric signals corresponding to image data and pressurizes liquid ink contained in a tank, so that the pressurized ink is discharged from a nozzle to perform printing. The electrostatic method uses powder or liquid (in a form of spray) ink which is electrically charged. The ink is discharged from a nozzle by electrostatic suction while a shutter provided at the nozzle tip is opened or closed according to the electric signals corresponding to image data, thereby performing printing.

However, in the ink-jet method, air may enter the ink tank, which would make sufficient pressurization in the ink tank impossible and therefore disable the apparatus from printing. Moreover, when the apparatus uses liquid ink, an ink clot may form at the nozzle or smearing of ink on the printing medium may cause image deterioration. Also in the electrostatic method, when powder ink is used, the ink particles may gather to form a lump due to blocking, thereby blocking the passage. When liquid ink is used in the electrostatic method, the ink clot may form at the nozzle or smearing of ink on the printing medium may also deteriorate the image quality, as in the ink-jet method.

As a method to solve the above-described problems, a method where sublimated or vaporized ink is discharged and is made to adhere onto the printing medium has been proposed. In this method, since gas is discharged, a blockage is less likely to occur. Moreover, since each pixel is constituted by ink molecules, high quality printing with high resolution, excellent gray scale characteristics and less smearing of ink can be performed. One example of an image printing apparatus using this method is disclosed in Japanese Patent Publication No. 56-2020.

In this image printing apparatus, ink contained in the printing head is heated by a heating device including an electric heater and a power source so that the ink is sublimated or vaporized to become gaseous ink and jetted from the printing heat. When the ink is jetted and passes through the charging electrode, voltage is applied across the charging electrode and the printing head, thereby charging the gaseous ink. The charged ink is then made to converge by an electric field lens and the converged ink is controlled by an electric field shutter whose operation is controlled by a signal source in such a manner that a prescribed amount of ink is discharged. The ink then flies toward the back electrode and an image is formed on the printing medium.

However, there are some problems listed below associated with this image printing apparatus.

(1) The ink, which is heated by the heating device and thus sublimated or vaporized, is continuously discharged from the printing head. Therefore, a portion of ink which is not actually used for printing is wasted, thereby raising the running cost.

(2) A device which recovers the unused portion of the gaseous ink and a device which cleans the area proximate to the electric field shutter are required. Therefore, miniaturization of the apparatus is difficult.

(3) The volume of the ink within the printing head expands due to the sublimation or vaporization of the ink and a pressure within the printing head increases, which is responsible for jetting the gaseous ink, thereby accomplishing a transfer of the gaseous ink from the printing head to the charging electrode. As a result, a response of the ink discharge is poor. Moreover, since the amount of ink within the printing head also affects the operation, unevenness in print density is likely to occur, thereby degrading a print quality.

SUMMARY OF THE INVENTION

The image printing apparatus for forming an image on a printing medium of this invention, includes at least two ink chambers for accommodating ink therein; heating means for heating the ink in the ink chambers to make the ink gaseous; discharging means for discharging the gaseous ink; and discharge controlling means for receiving an electrical signal corresponding to the image to be formed and for controlling the discharging means to intermittently discharge the gaseous ink in response to the electrical signal.

In one embodiment of the invention, the at least two ink chambers are mutually isolated and have the same volume.

In another embodiment of the invention, the heating means includes at least two heaters provided for the respective ink chambers.

In still another embodiment of the invention, the at least two heaters are controlled independently.

In still another embodiment of the invention, the ink chambers are provided as a part of a printing head which is formed of a member having excellent thermal conductivity, and any two of the ink chambers adjacent to each other are thermally insulated by a thermal insulator.

In still another embodiment of the invention, the at least two ink chambers include a first ink chamber and a second ink chamber having a volume larger than that of the first ink chamber, and wherein the ink accommodated in the second ink chamber is heated to generate gaseous ink to be discharged toward the printing medium while the ink accommodated in the first ink chamber is heated to provide a short term supply of gaseous ink during printing.

In still another embodiment of the invention, the at least two ink chambers are provided as a part of a printing head and include a first ink chamber and a second ink chamber having a larger volume than that of said first ink chamber. An inner wall of the upper part of the printing head is an incline descending from an upper part of the second ink chamber to an upper part of the first ink chamber.

In still another embodiment of the invention, the heating means is driven to heat the ink at a temperature lower than a temperature where the ink becomes gaseous when printing is not performed.

In still another embodiment of the invention, the at least two ink chambers includes three or four ink chambers which accommodate three colors of ink or four colors of ink. The heating means includes three or four heaters provided for the respective three or four ink chambers, the three or four heaters being controlled independently in accordance with color data for the three colors or the four colors.

In still another embodiment of the invention, the discharging means includes: a charging electrode for electrically charging the gaseous ink; and a back electrode provided on the back side of the printing medium, thereby guiding the charged gaseous ink onto the printing medium.

In still another embodiment of the invention, the discharge controlling means includes: a shutter mechanically for electrically controlling the discharge of the gaseous ink; and a controller sending to the shutter a signal corresponding to the electrical signal to be received and controlling the shutter.

According to another aspect of the invention, an image printing apparatus for forming an image on a printing medium includes: a printing head including two ink chambers and a shutter; a heater provided under the two ink chambers; a charging electrode provided between the printing medium and the two ink chambers; a back electrode provided on a side of the printing medium which is opposite a side on which the image is formed; and a controller associated with the shutter, the heater and the charging electrode.

The function of the present invention is as follows.

If two or more ink chambers are provided and a heating device (heating means) is provided to each of the ink chambers, which is independently controlled, then the thermal capacity of the ink contained in each of the ink chambers can be reduced without reducing the overall amount of the ink. Therefore, a time required to sublimate or vaporize the ink can be shortened. As a result, it becomes possible to promptly generate a necessary and sufficient amount of the sublimated or vaporized ink in response to an image signal. This makes it possible to always supply the most appropriate amount of the sublimated or vaporized ink without experiencing a short supply or an excessive supply of the sublimated or vaporized ink.

Moreover, if the printing head is made to have a structure where the printing head is formed of members having excellent thermal conductivity and the two ink chambers provided therein are thermally insulated by a thermal insulator, then the ink chamber to be heated can be heated in a concentrated manner. The heating efficiency can be enhanced accordingly and, since sublimation of ink can be prompted, the warm up time can be shortened.

Moreover, if the printing head includes a first ink chamber and a second ink chamber which has a larger volume capacity for ink than the first chamber, if the inner surface of the upper wall of the printing head is formed as an incline descending from the upper part of the second ink chamber to the upper part of the first chamber, and if the ink is heated by the heating device at a temperature lower than the sublimation temperature when the printing is not performed, then a portion of ink which is once sublimated or vaporized, but is not discharged and remains on the upper wall of the ink chamber flows along the incline and is recovered in the smaller volume ink chamber. Thus, ink can be reused.

Moreover, if the printing head includes three or more ink chambers or more having the same volume capacity, if different kinds of ink are contained in the ink chambers, and if each of the ink chambers is heated in response to image data, then the different kinds of ink having different colors can simultaneously be discharged for printing. Therefore, if, for example, three kinds of ink having colors of yellow, magenta and cyan are contained in the ink chambers, then a time necessary to form a color image can be considerably reduced compared to the case where the color image is obtained by overlaying the three colors.

Moreover, if heating of the ink chambers is independently controlled, an amount of the sublimated or vaporized ink in each of the ink chambers can be constantly maintained without being affected by the difference in the sublimation temperature or vaporization temperature of ink or in image data for different colors. As a result, the short supply or the excessive supply of a specific color does not occur.

Thus, the invention described herein makes possible the advantage of providing an image printing apparatus which does not waste ink and can reduce the running cost. Such an image printing apparatus can also be miniaturized and can promptly prepare a necessary and sufficient amount of ink which corresponds to image signals, thereby reducing the printing time.

The invention described herein also makes possible the advantage of providing an image printing apparatus which can discharge a necessary and sufficient amount of different colored ink, thereby increasing the image quality without being affected by the difference in the sublimation temperature of ink or by the difference in the image data among different colors.

These and other advantages of the present invention will become apparent to those skilled in the art upon reading and understanding the following detailed description with reference to the accompanying figures.

DESCRIPTION OF THE PREFERRED EMBODIMENTS

First, an image printing apparatus which the present applicant previously proposed in Japanese Patent Application No. 7-49778 will be described. This image printing apparatus can overcome the problems associated with the aforementioned conventional image printing apparatus.

Figure 17:
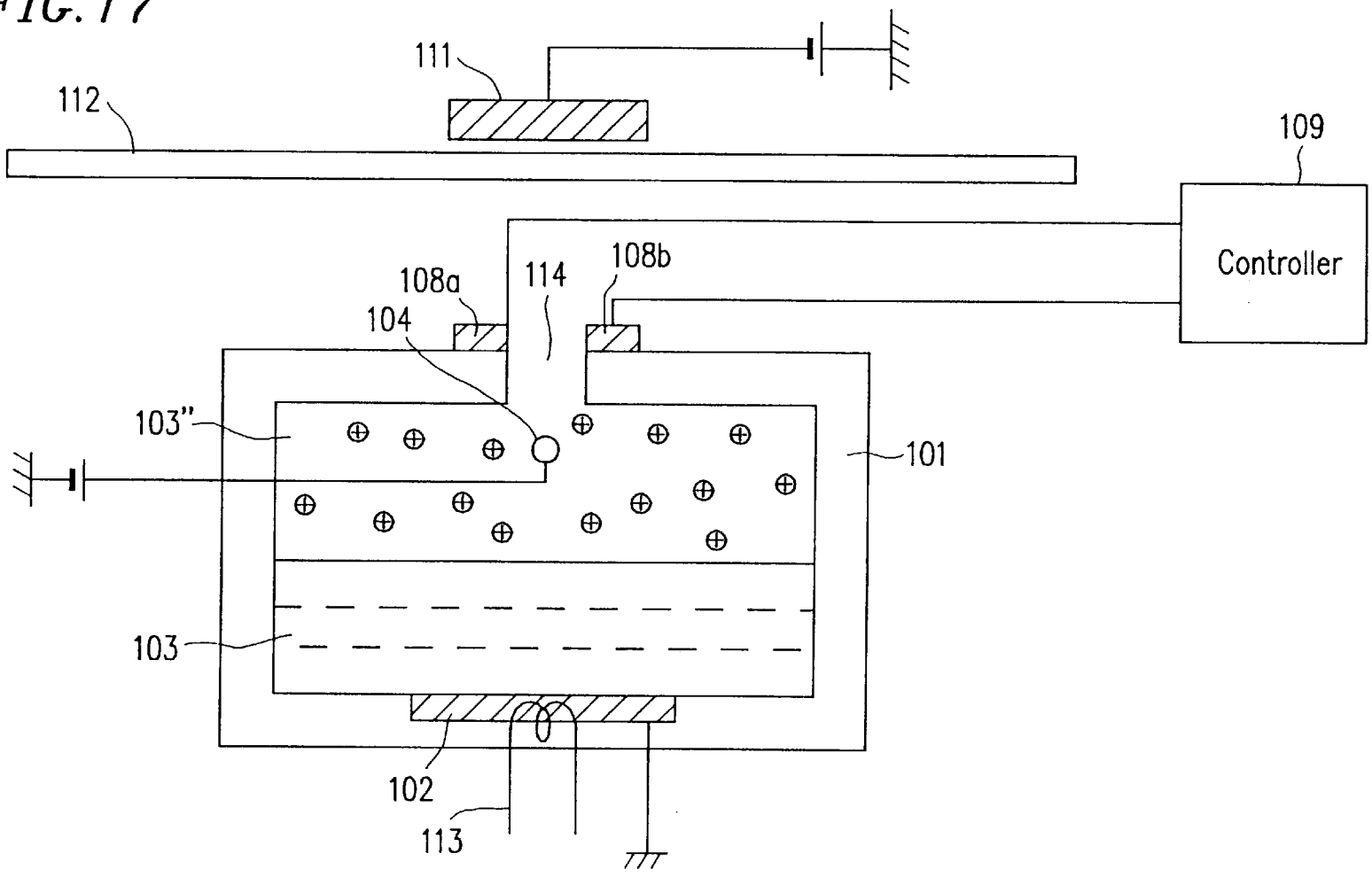
FIG. 17 is a schematic cross-sectional view seen from the front illustrating an image printing apparatus previously proposed by the present applicant.

FIG. 17 illustrates this image printing apparatus. A printing head 101 whose front view is illustrated as a box contains powder ink 103. A heating device 102 which heats and sublimates the ink 103 is provided at the bottom of the printing head 101. The heating device 102 includes an electric heater 113 and a radiator panel which is not shown in the figure.

The sublimated ink 103" rises in the printing head 101 and stays above the powder ink 103. In this region of sublimated ink, a charging electrode 104 which is made of a thin wire electrode having a diameter of 50 to 100 $\mu$m is provided. Provided on the top surface of the printing head is a discharging spout 114 for the sublimated ink 103". A common electrode 108*a* and a control electrode 108*b* are provided on both sides of the discharging spout 114 and these electrodes constitute an electric field shutter 108. The control electrode 108*b* receives an output signal corresponding to image data to be formed from a controller 109.

Above the printing head 101 is a printing medium (printing paper) 112, which is supported and carried laterally, and a back electrode 111 is provided above the printing medium 112, i.e., on the back side of the printing medium 112.

The image printing apparatus having the above-described structure operates as follows.

The powder ink 103 is heated by the heating device 102 and voltage of +2 to +5 kV is applied to the charging electrode 104. This initiates a corona discharge in the direction of the heating device 102 which is grounded and the sublimated ink 103" is charged as positive ions. If a negative voltage of, for example, −0.5 to −2 kV is applied to the back electrode 111 in this condition, the sublimated ink 103" is driven onto the printing medium 112.

The common electrode 108*a* of the electric field shutter 108 is grounded, and the control electrode 108*b* is applied with a voltage of between +50 V to +1 kV (high level: "H" level) or a voltage of 0 V (low level: "L" level) by the aforementioned controller 109. When the voltage to be applied to the control electrode 108*b* is, for example, a "H" level of 500 V, the electric field shutter 108 is turned ON and an electric field is generated from the control electrode 108*b* to the common electrode 108*a*. Therefore, the positively charged sublimated ink 103" cannot go through the electric field shutter 108.

On the other hand, when the voltage to be applied to the control electrode 108*b* is a "L" level of 0 V, no electric field is generated between the control electrode 108*b* and the common electrode 108*a*, and the sublimated ink 103" is attracted by an electric field generated by the back electrode 111 and can go through the electric field shutter 108. The electric field shutter 108 is operating in the OFF state in this case.

As described above, according to the above-described image printing apparatus, since the discharge of the sublimated ink 103" can be controlled to be intermittent by the ON/OFF of the voltage applied to the control electrode 108*b*, only an amount of ink necessary for printing is discharged. As a result, unlike the aforementioned conventional image printing apparatus, the ink is not wasted and the running cost can be reduced. Moreover, since a device for recovering the unused portion of the sublimated ink and a device for cleaning the peripheral area of the electric field shutter are not required, miniaturization of the apparatus can be accomplished.

In the image printing apparatus, one of the electrodes constituting the electric field shutter 108 may be replaced by a plurality of electrode portions which are arranged with a gap in accordance with the desired print density and correspond to the pixels. In this case, by controlling a voltage to be applied to each of the electrode portions, the ONs and OFFs of the sublimated ink 103" can be controlled in units of pixels.

In the image printing apparatus as shown in FIG. 17, liquid ink 103 may be used in place of solid ink 103.

Even in the image printing apparatus having a configuration as shown in FIG. 17, however, the following problems must be solved.

A time required for printing must be reduced. The reason is that one of the requirements imposed on recent image printing apparatuses is the reduction in the time required for printing. Since the image printing apparatus previously proposed by the present applicant requires that the solid or liquid ink should be sublimated or vaporized by heating the ink prior to the printing, the printing cannot be performed until an amount of ink necessary for the printing is sublimated or vaporized. That is, this image printing apparatus inherently requires a warm up time like a typical copier.

One method to reduce this warm up time is to increase the electric power to be supplied to the heating device. This can raise the heating temperature, thereby reducing a time required for the sublimation or the vaporization of ink.

However, since portable apparatuses require reduced energy consumption, it is not preferable to apply this method to such apparatuses. Moreover, since this method requires heat radiation measures due to generation and accumulation of heat within the apparatus or a variety of corrections associated with the printing, a major design change becomes necessary. The method is, therefore, not preferable.

Another method is to reduce the amount of ink to be contained in the printing head so that the thermal capacity of ink to be heated is reduced. However, this method requires a new supply of ink more often and the operability is degraded. The method is, therefore, not preferable.

Hereinafter, embodiments of the present invention which can overcome not only the problems associated with the conventional image printing apparatus but also the problems of the image printing apparatus having a configuration as shown in FIG. 17, will be described.

(Embodiment 1)

Figure 1:
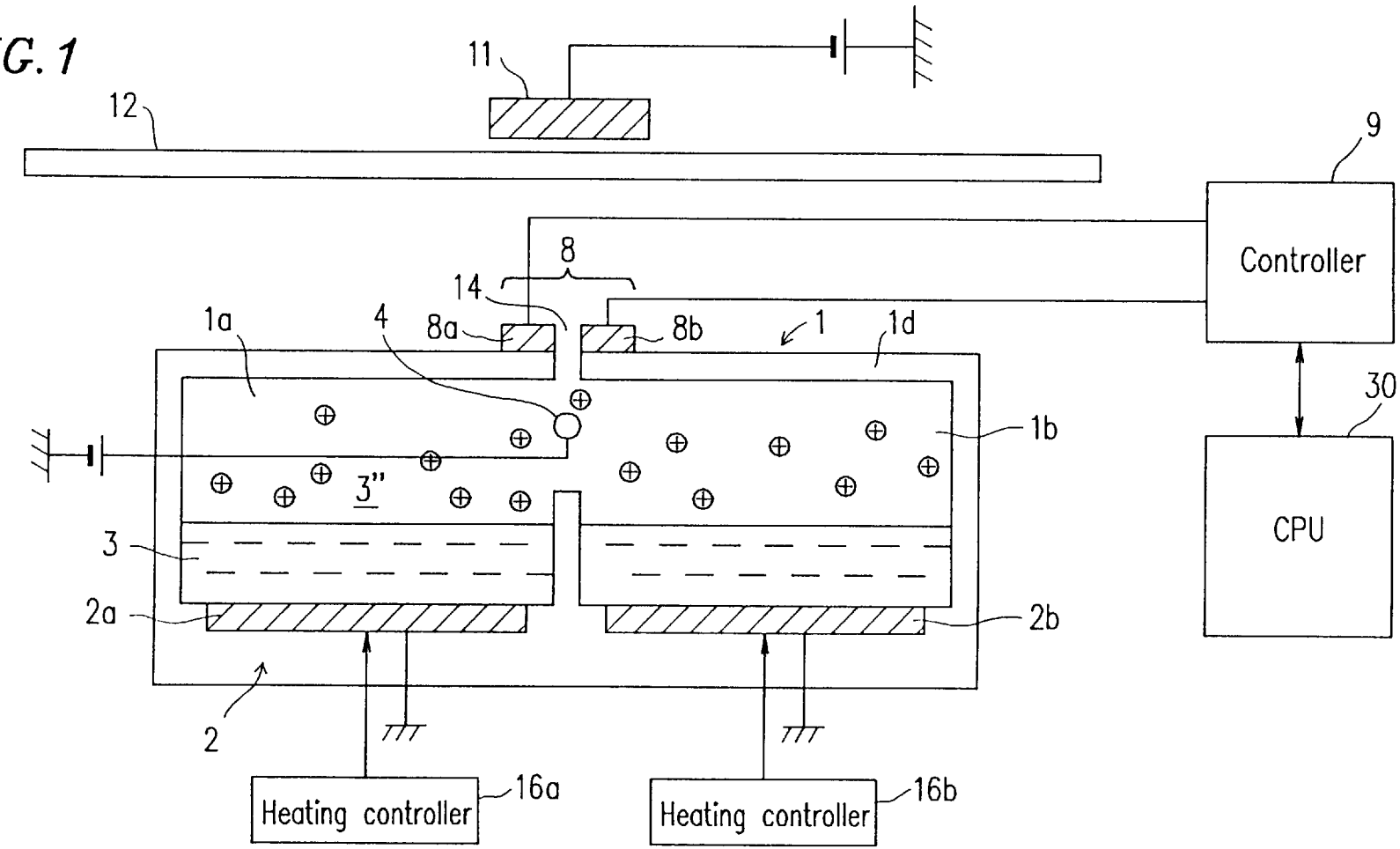
FIG. 1 is a schematic cross-sectional view seen from the front illustrating a printing head and a peripheral structure thereof of an image printing apparatus of the present invention according to Embodiment 1.

FIG. 1 illustrates the structure of a printing head and its peripheral area of an image printing apparatus according to Embodiment 1 of the present invention. The printing head 1 has a shape of a rectangular box elongated sideways when viewed from the front and includes two ink chambers having the same internal dimensions. Hereinafter, the ink chamber on the left is referred to as the first ink chamber 1*a* and the ink chamber on the right is referred to as the second ink chamber 1*b*. Solid color ink 3 is contained in both of the ink chambers 1*a* and 1*b* in a mutually separated condition. Alternatively, liquid ink may be contained in the ink chambers. The printing head 1 is constituted of members having excellent thermal conductivity.

Heating devices 2*a* and 2*b* are provided in the bottom of the printing head 1 which correspond to the lower parts of the ink chambers 1*a* and 1*b*. The ink chambers 1*a* and 1*b*, corresponding to the heating devices 2*a* and 2*b*, respectively, are heated separately. Each of the heating devices 2*a* and 2*b* include an electric heater and a radiator panel (both not shown in the figure), and heating controllers 16*a* and 16*b* control the heating.

When the first and second ink chambers 1*a* and 1*b* are heated by the heating devices 2*a* and 2*b*, upper parts of both ink chambers 1*a* and 1*b* are filled with sublimated ink 3". Since the upper parts of the ink chambers 1*a* and 1*b* are in communication, the gaseous ink 3" sublimated in the ink chambers 1*a* and 1*b* is mixed together.

The central portion of the upper wall 1*d* of the printing head 1 has an opening having an appropriate width which serves as an ink discharging spout 14. Since the ink discharging spout 14 is located at this position, the gaseous ink 3" sublimated in the first and second ink chambers 1*a* and 1*b* is evenly discharged upward from the printing head 1.

A charging electrode 4 for electrically charging the sublimated ink 3" is provided in the printing head 1. This charging electrode 4 is made of, for example, a thin wire having a diameter of about 50 to 100 $\mu$m.

Figure 2:
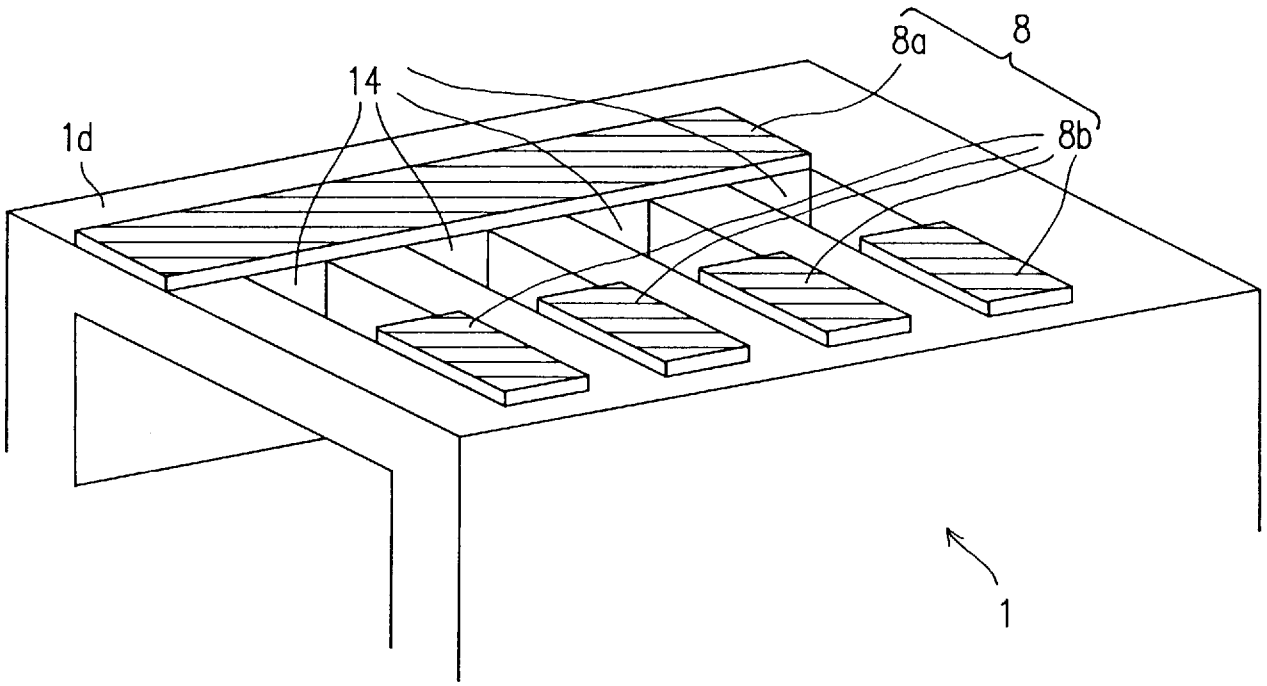
FIG. 2 is a perspective view illustrating one embodiment of an electric field shutter of an image printing apparatus of the present invention.

In addition, a common electrode 8*a* and a control electrode 8*b* are provided on both sides of the ink discharging spout 14. The common electrode 8*a* and the control electrode 8*b* together constitute an electric field shutter 8. FIG. 2 illustrates one embodiment of the electric field shutter 8. As apparent from the figure, a plurality of ink discharging spouts 14 are provided to the printing head 1 along the direction from the front to the back, and the same number of control electrodes 8*b* as the ink discharging spouts 14 are provided, corresponding to each ink discharging spout 14. These plurality of ink discharging spouts 14 are formed for a length, corresponding to a print width, and if, for example, the print density is 150 dpi, then the gap therebetween is set to be 200 $\mu$m.

Figure 3:
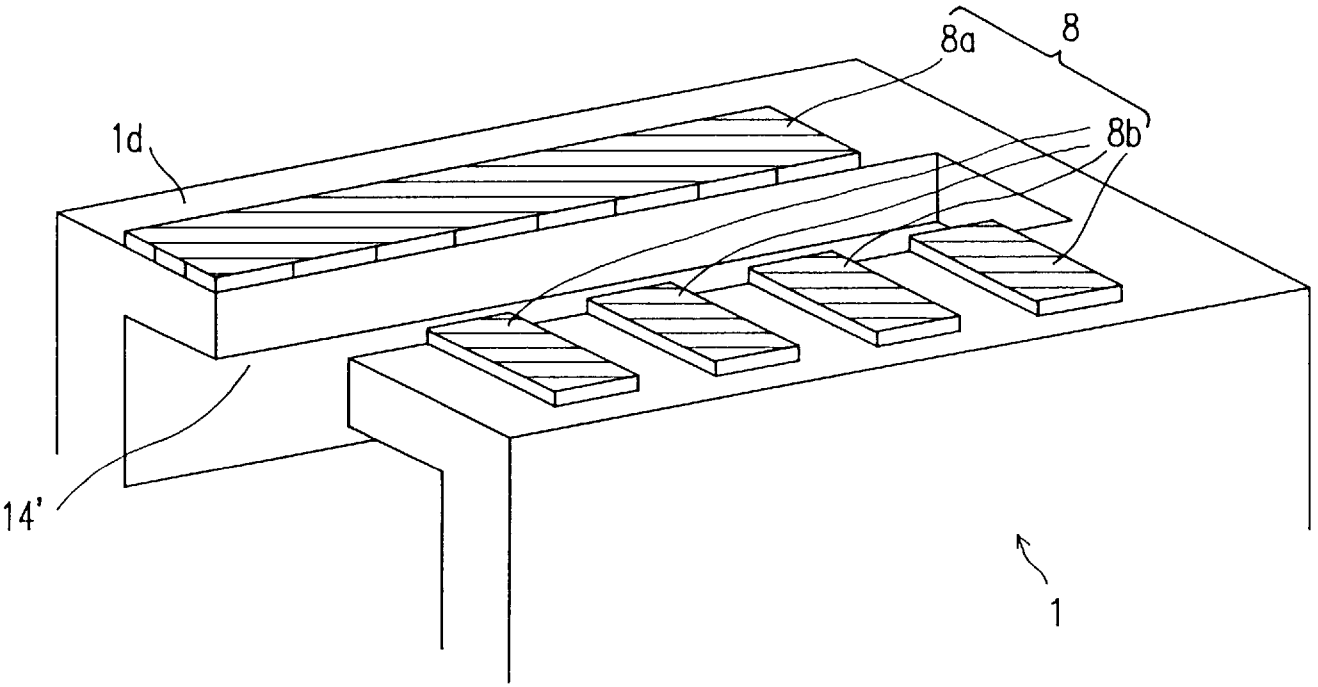
FIG. 3 is a perspective view illustrating another embodiment of the electric field shutter.

FIG. 3 illustrates another embodiment of the electric field shutter 8. In this example, the ink discharging spout 14' is made of a single slit. When the printing head 1 is a line head, the length of this slit is chosen to be the length corresponding to the print width. For example, if the printing medium 12 (printing paper) is A4 size, then the length of the slit is about 200 mm, and if it is A5 size, then the length is about 140 mm. Moreover, if the print density is 150 dpi, then the slit is chosen to be 200 $\mu$m. In this embodiment, since the ink discharging spout 14' is made of a single slit, the ink discharging spout is less likely to get blocked compared to the ink discharging spout in the embodiment illustrated in FIG. 2.

Output signals corresponding to image data to be formed are supplied to the control electrode 8*b* from the controller 9. The electric field shutter 8 and the controller 9 constitute a discharge controller. Above the printing head 1 is where the printing medium 12 is carried along, and a back electrode 11 is provided above the printing medium 12, i.e., on the back side of the printing medium 12.

Next, the operation of this image printing apparatus will be described with reference to FIGS. 4A to 4H.

Figures 4A, 4B, 4C, 4D, 4E, 4F, 4G, 4H:
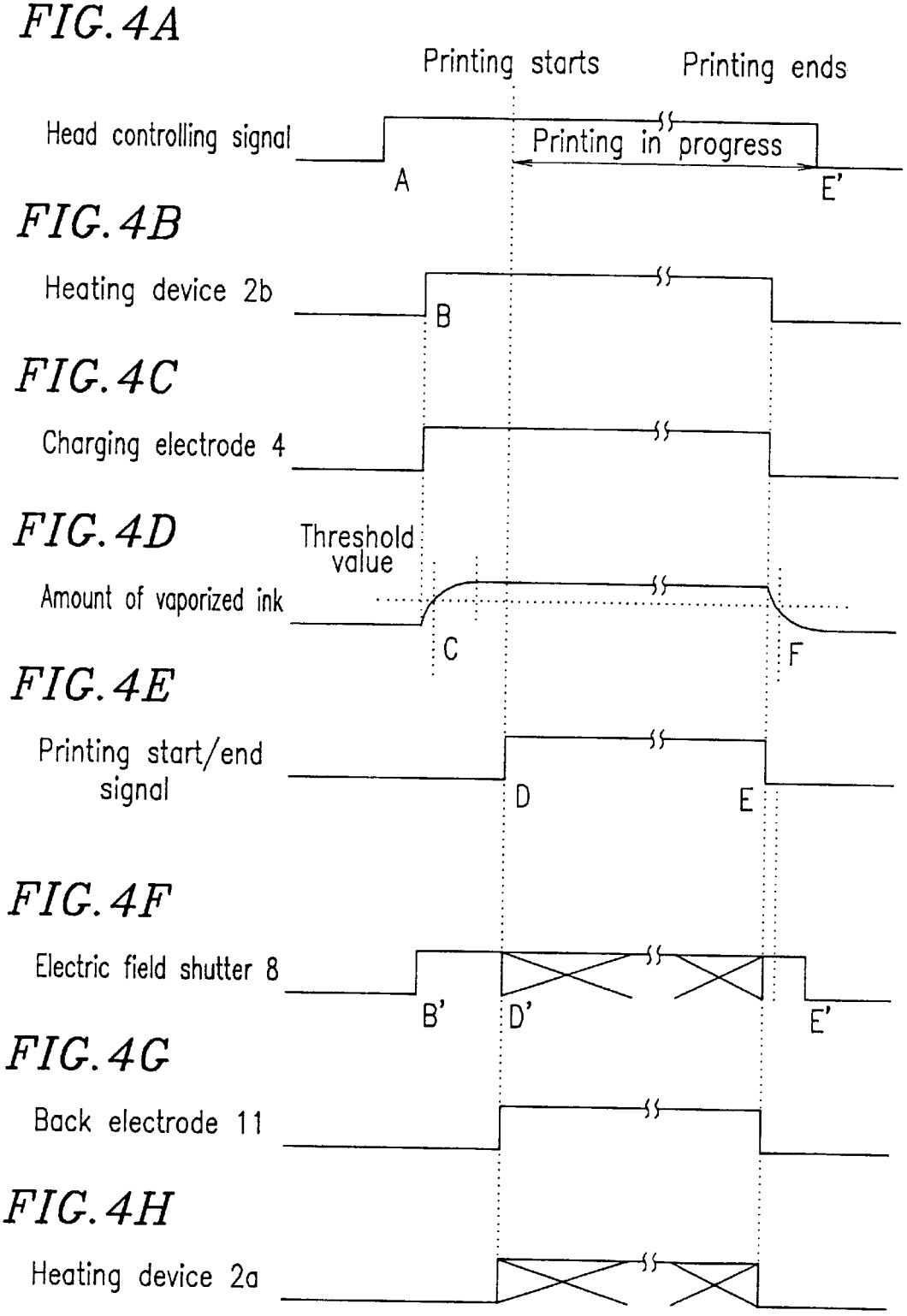
FIGS. 4A to 4H are timing diagrams illustrating the operation of an image printing apparatus of Embodiment 1.

A head controlling signal having a waveform shown in FIG. 4A is transmitted to the printing head 1 having the above-described structure from the CPU 30 which functions as a control center of the image printing apparatus. This head controlling signal indicates that the printing head 1 is non-functional when the signal is a "L" level and that the printing head 1 is functional when the signal is a "H" level. Moreover, a rise from the "L" level to the "H" level indicates when the printing head operation starts, and a fall from the "H" level to the "L" level indicates when the printing head operation ends.

When the head controlling signal is transmitted to the printing head 1, the heating controller 16*b* controls the heating device 2*b* as in the timing diagram shown in FIG. 4B. That is, with the rise of the head controlling signal (point A in FIG. 4A) being a trigger, the heating controller 16*b* starts driving the heating device 2*b* at point B which is after a prescribed time period from point A. As illustrated in FIG. 4C, a voltage of between about +2 to +5 kV ("H" level) is applied to the charging electrode 4 at this time.

When the heating device 2*b* is driven as in the timing diagram shown in FIG. 4B, the ink 3 in the ink chamber 1*b* is heated. When the temperature reaches or exceeds the sublimation temperature $T_g$, the ink 3 turns into gaseous ink 3" via sublimation. As illustrated in FIG. 4D, the amount of the gaseous ink 3" increases with time, reaching a threshold value at point C. Here, the threshold value of the ink amount refers to an amount of ink sufficient to be discharged. If the ink amount reaches or exceeds the threshold value, the printing is ready to be performed. It also means that the ink chamber is filled with the high pressure gaseous ink 3".

The heating device 2*b* is controlled by the heating controller 16*b* so that the temperature T is maintained at or above the ink sublimation temperature $T_g$. That is, the following relationship (1) holds between the temperature T and the ink sublimation temperature $T_g$.

$$T=T_g+\Delta T \tag{1}$$

In the above equation (1), ΔT is determined by taking into consideration the thermal stability of the heating controller 16*b*, the change in the ambient temperature, etc. For example, when the ink sublimation temperature $T_g$ is 140° C., ΔT is taken to be 15° C. and the heating device 2*b* is controlled such that T=155° C.

Although the starting point for driving the heating device 2*b* is taken to be point B in Embodiment 1, it is possible to start driving the heating device 2*b* before point B. For example, it is possible to start driving the heating device 2*b* at point B' shown in FIG. 4F. In that case, a voltage of about 50 V to 1 kV ("H" level) is applied to all the control electrodes 8*b* illustrated in FIG. 2, thereby turning ON the electric field shutter 8. This generates an electric field from the control electrodes 8*b* to the common electrode 8*a* so that the positively charged gaseous ink 3" cannot go through the electric field shutter 8, thereby preventing a leak of the gaseous ink 3".

At point D shown in FIG. 4E, which is after a prescribed time interval from when the driving of the heating device 2*b* is started, i.e., when the amount of gaseous ink reaches or exceeds the threshold value and the apparatus becomes ready to start printing, a printing start/end signal is output from the CPU 30 to the controller 9. This printing start/end signal indicates that the printing head 1 is in the non-printing condition when the signal is at a "L" level and that the printing head 1 is in the printing condition when the signal is at a "H" level. Moreover, a rise from the "L" level to the "H" level indicates when the printing operation starts, and a fall from the "H" level to the "L" level indicates when the printing ends.

In Embodiment 1, an actual measurement of whether or not the amount of the gaseous ink 3" exceeds the threshold value is not performed. Rather the determination is made based on the temperature $T_H$ of the printing head 1 or on a time $t_{th}$ passed since the time of starting the heating of the heating device 2*b*. That is, by driving the heating device 2*b* to heat the printing head 1 in a laboratory, a relationship between the head temperature and the amount of the gaseous ink 3" to be sublimated or between the time passed since the time of starting the heating of the printing head 1 and the amount of the gaseous ink 3" to be sublimated is obtained. Then, based on the obtained data, the CPU 30 determines when to output the aforementioned printing start/end signal to the controller 9.

The description will now be given in more detail. The amount of the generated gaseous ink 3" generated is measured by actually performing printing on a sheet of paper and by measuring the print density. Then, the generation amount characteristic of the gaseous ink 3" with respect to the temperature of the printing head 1 or with respect to the time passed since the time of starting the heating of the printing head 1, which is obtained accordingly, is used to obtain the head temperature $T_H$ or the passed time $t_{th}$ required for a desired density of printing to be realized. Then, the obtained data is stored, for example, in a memory region of the CPU 30 as the base data for the determination. Then, the actual head temperature $T_H$ or the passed time $t_{th}$, which is measured when the apparatus is in use, is compared to the above base data by the CPU 30. The CPU 30 then determines whether or not the amount of the gaseous ink 3" exceeds the threshold value from the result of the comparison and outputs the printing start/end signal to the controller 9.

With the rise of the printing start/end signal (see FIG. 4E) being a trigger, the controller 9 requests image data to be transmitted from an image memory (not shown in the figure) and, upon completion of the data transmission, outputs ON/OFF signals corresponding to the image data to the electric field shutter 8 (FIG. 4F). The electric field shutter 8 is connected to a power source (not shown in the figure) which selectively supplies a voltage of 500 V so that the voltage at the shutter 8 is turned ON/OFF, corresponding to the image data. Moreover, as illustrated in FIG. 4G, a voltage of −1 kV is applied to the back electrode 11 at point D' (see FIG. 4F) where ON/OFFs of the electric field shutter 8 is begun, thereby initiating the printing. As illustrated in FIG. 4E, the printing start/end signal is maintained at the "H" level during the printing.

In the above description, only the heating device 2*b* is driven to sublimate the ink 3 so as to generate the gaseous ink 3" when the printing start/end signal of "H" level is sent from the CPU 30 to the printing head 1. However, it is also possible to start driving the other heating device 2*a* at point B in the timing diagram illustrated in FIG. 4B so that both the ink chambers 1*a* and 1*b* are heated to generate the gaseous ink 3". Since the amount of the gaseous ink 3" generated in a unit time can be increased in this driving method, the time required for the apparatus to become ready to print can be further reduced.

In the latter driving method, the driving of one of the heating devices may be stopped once the apparatus becomes ready to print, and the generation of the gaseous ink 3" may be performed only by driving the other heating device. This prevents the gaseous ink 3" from being excessively generated. In addition, the heating device whose operation is stopped after the printing operation may be driven during the next printing operation, whereas the driving of the heating device which continues to be driven may be stopped during the next printing operation. Such an alternate driving of the heating devices can make the consumption rates of the ink 3 in the ink chambers 1*a* and 1*b* almost equal and, therefore, the supply of the ink 3 to each ink chamber is required less often.

When the printing operation described above is finished, the printing start/end signal falls from the "H" level to the "L" level at point E illustrated in FIG. 4E. With this fall being a trigger, the heating devices 2*a* and 2*b*, the charging electrode 4 and the back electrode 11 all return to the OFF state (see FIGS. 4B, 4H, 4C and 4G).

In Embodiment 1, since the gaseous ink 3" is not immediately cooled upon shut down but remains in the ink chambers 1*a* and 1*b* even if the heating controllers 16*a* and 16*b* shut down the power supply to the heating devices 2*a* and 2*b*, the electric shutter 8 is unconditionally turned ON when the printing is finished so as to prevent the ink from leaking as illustrated in FIG. 4F. Then, the electric field shutter 8 is turned OFF at point E' which is after a prescribed time past the time of finishing the printing and maintained in this condition until a next printing operation begins.

In the image printing apparatus according to Embodiment 1, the ink chamber is broken up into a plurality of ink chambers having a small volume, each of which is independently heated to generate the gaseous ink 3". Therefore, compared to the image printing apparatus previously proposed by the present applicant which includes a single ink chamber having a large volume, the thermal capacity of each ink chamber is small. Because of this, the rate of increase in temperature from the time of heating initiation is large. As a result, the time required for the ink to be sublimated can be reduced accordingly. That is, since the time required to generate the gaseous ink 3" can be shortened, when the amount of gaseous ink 3" in the ink chamber is low, the resupply can be made quickly. Moreover, the reduction in the ink sublimation time makes it possible to generate a necessary and sufficient amount of gaseous ink 3" in accordance with the image signal. In other words, supply of a necessary amount of ink corresponding to the image data to be formed can be performed more precisely. Therefore, the most appropriate amount of ink can be always supplied without creating either the short supply or the excessive supply of the gaseous ink 3".

(Embodiment 2)

Figure 5:
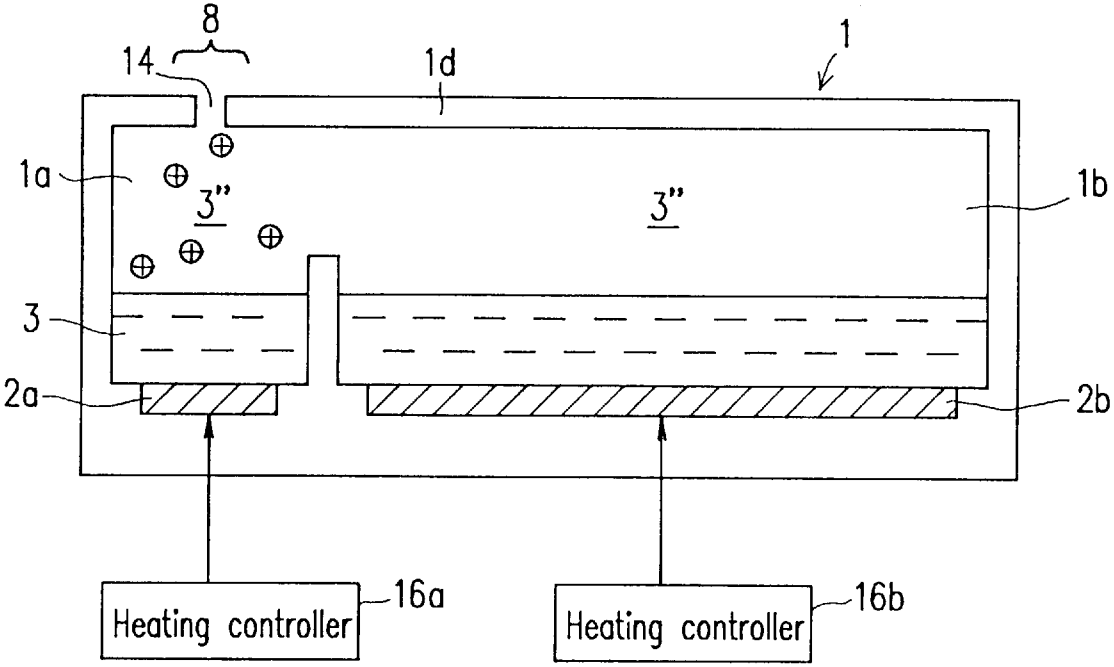
FIG. 5 is a cross-sectional view seen from the front illustrating a main portion of an image printing apparatus of Embodiment 2.

FIG. 5 is the cross-sectional view seen from the front illustrating a main portion of an image printing apparatus of the present invention according to Embodiment 2. The same reference numerals are used to refer to corresponding parts, and the descriptions thereof are omitted.

In Embodiment 2, the apparatus has the same structure as in Embodiment 1 except that the volumes of the first ink chamber 1*a* and the second ink chamber 1*b* are different, the volume being smaller for the first ink chamber 1*a* than for the second ink chamber 1*b*. The ink 3 in the first ink chamber 1*a* of a smaller volume is heated to sublimate so as to be the gaseous ink 3" at the initial stage of the printing. Therefore, according to Embodiment 2, a warm up time for the apparatus to become ready to print can be further reduced.

(Embodiment 3)

Figure 6:
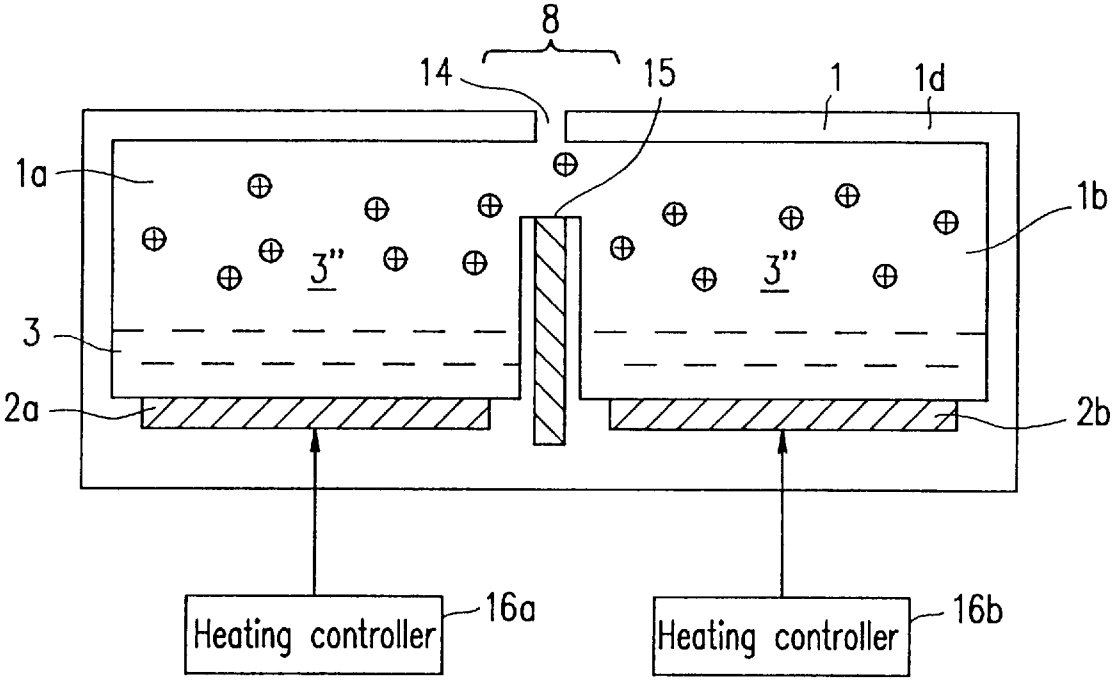
FIG. 6 is a cross-sectional view seen from the front illustrating a main portion of an image printing apparatus of Embodiment 3.

FIG. 6 is the cross-sectional view seen from the front illustrating a main portion of an image printing apparatus of the present invention according to Embodiment 3. In Embodiment 3, the apparatus has the same structure as in Embodiment 1 except that the first ink chamber 1*a* and the second ink chamber 1*b* are separated by a thermal insulator 15.

According to Embodiment 3, the heating of the ink 3 in the first ink chamber 1*a* and the second chamber 1*b* can be performed more efficiently than in Embodiment 1 for the following reasons, so that a larger amount of ink can be sublimated with less electric power.

In the structure of Embodiment 1, since the first ink chamber 1*a* and the second chamber 1*b* are not thermally insulated, heat generated by, for example, the heating device 2*b* disperses to the entire portion of the printing head 1 due to the high thermal conductivity of the printing head and, therefore, the ink 3 in the second ink chamber 1*b* cannot be efficiently heated. As a result, heating efficiency is low and more electric power is required.

In Embodiment 3, however, since the first ink chamber 1*a* and the second ink chamber 1*b* are thermally insulated by the thermal insulator 15, heat supplied to the ink 3 within the second ink chamber 1*b* is prevented from escaping to the first ink chamber 1*a*. As a result, the ink 3 within the second ink chamber 1*b* is heated in a concentrated manner to sublimate, thereby generating the gaseous ink 3" efficiently with less electric power.

In FIG. 6, the bottom of the printing head 1 is connected with a member having excellent thermal conductivity so that the first ink chamber 1*a* and the second ink chamber 1*b* are not entirely separated. As a result, a portion of the heat generated by the heating device 2*b* is transferred by thermal conduction to the first ink chamber 1*a*. However, since this heat moderately heats a portion of the printing head constituting the first ink chamber 1*a* constantly, the heating device 2*a* requires less electric power.

It is possible to apply the structure of Embodiment 3 to that of Embodiment 2.

(Embodiment 4)

Figure 7:
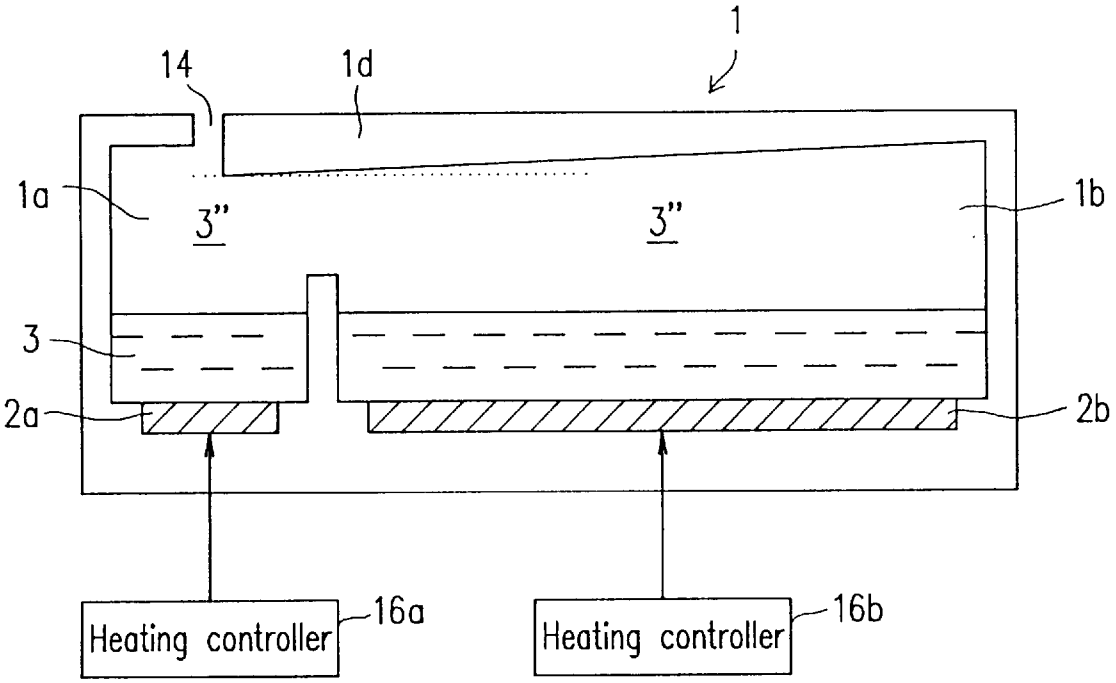
FIG. 7 is a cross-sectional view seen from the front illustrating a main portion of an image printing apparatus of Embodiment 4.

FIG. 7 is the cross-sectional view seen from the front illustrating a main portion of an image printing apparatus of the present invention according to Embodiment 4. Embodiment 4 deals with an image printing apparatus including a plurality of (two in FIG. 7) ink chambers having different volumes, which is characterized by the structure where a consumption of ink 3 in a small ink chamber 1*a* is reduced. The structure will be described as follows. The same reference numerals are used to designate the same parts as in the aforementioned embodiments and the descriptions thereof are omitted. Only the different parts will be described.

As illustrated in FIG. 7, an incline is provided on the surface of the upper wall 1*d* of the printing head 1, descending from the second ink chamber 1*b* to the first ink chamber 1*a*. The printing head 1 is constituted of members having excellent thermal conductivity as in the aforementioned embodiments.

By making the printing head to have the above-described structure, a consumption of ink 3 in the small ink chamber 1*a* can be reduced for the following reason.

When the ink 3 is heated and then sublimated, the ink chambers 1*a* and 1*b* are filled with the gaseous ink 3". When the printing is finished and the electric power to the heating devices 2*a* and 2*b* is shut down, a portion of the gaseous ink 3" not discharged and remaining in the ink chambers 1*a* and 1*b* becomes liquified as the temperature inside the printing head falls. A portion of the gaseous ink is liquified and drops into a pool of solid ink 3, but other portions making contact with the surface of the upper wall 1*d* of the ink chambers 1*a* and 1*b* turn into liquified ink there and adhere to the surface. If the head has a conventional shape, then when the temperature further drops in this condition, the ink adhering to the surface of the upper wall 1*d* solidifies there. Since the area of the surface of the upper wall 1*d* is apparently larger for the second ink chamber 1*b* having large volume than for the first ink chamber 1*a* having small volume, more ink 3 adhere to the surface of the upper wall in the second ink chamber 1*b*.

However, if the upper wall 1*d* of the printing head has the shape of the present embodiment, the liquified ink adhering to the surface of the upper wall 1*d* in the ink chamber starts to flow along the incline on the surface of the upper wall 1*d* toward the first ink chamber 1*a* and drops into the ink pool provided immediately below in the first ink chamber 1*a* to be recovered.

As described above, by making the surface of the upper wall 1*d* of the ink chamber to have an incline descending from the second ink chamber 1*b* to the first ink chamber 1*a*, the ink which adheres to the surface of the upper wall 1*d* of the ink chamber can be automatically recovered.

(Embodiment 5)

FIGS. 8A to 8G are timing diagrams illustrating the operation of an image printing apparatus of the present invention according to Embodiment 5. In Embodiment 4, the ink is recovered due to the shape of the printing head as described above. In Embodiment 5, the ink is recovered by controlling the operation as follows.

Figures 8A, 8B, 8C, 8D, 8E, 8F, 8G:
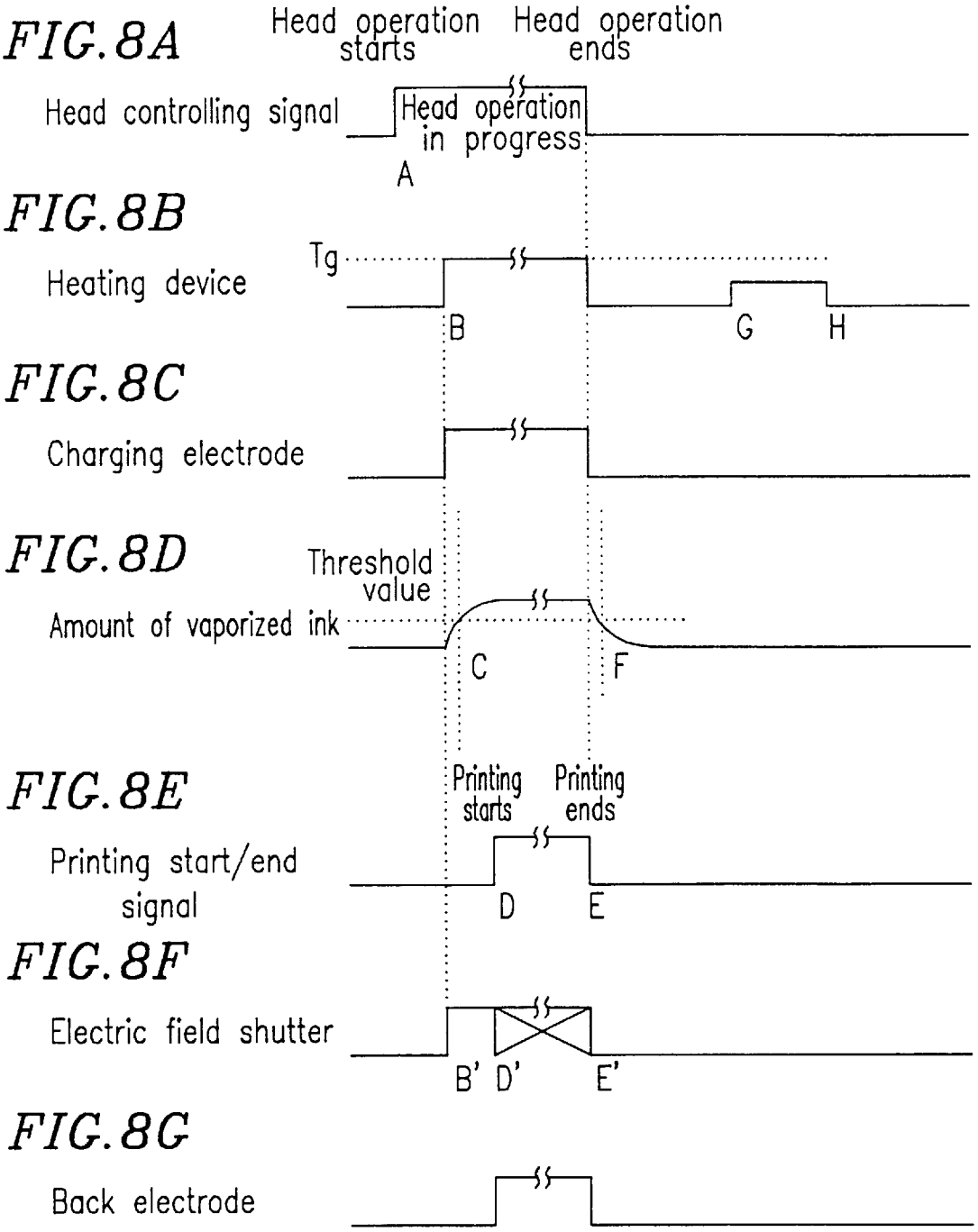
FIGS. 8A to 8G are timing diagrams illustrating the operation of an image printing apparatus of Embodiment 5.

As illustrated in FIGS. 8A and 8B, the heating devices 2*a* and 2*b* are driven to heat the ink 3 at an arbitrary point (a point G in FIG. 8B) before the printing operation of the printing head 1 is started again, that is, at the arbitrary point where the head controlling signal is at a "L" level. It is noted that in this heating process the heating devices 2*a* and 2*b* are controlled so that the ink heating temperature is not to exceed the ink sublimation temperature $T_g$. Therefore, the gaseous ink 3" is not generated in this heating process. This heating process ends at another arbitrary point (a point H in FIG. 8B) before the printing operation is started again.

Since the printing head 1 is constituted of members having excellent thermal conductivity as described above, the temperature at the surface of the upper wall 1*d* of the ink chambers 1*a* and 1*b* also rises to a temperature almost the same as the heating temperature. As a result, the solid ink 3 adhering to the surface becomes liquified. If vibration or the like is provided, the liquified ink drops into the ink pool and is recovered.

The present embodiment can be applied to any of the previous embodiments. In particular, when combined with Embodiment 4, the recovery of ink is further facilitated because of the mutually beneficial effect.

(Embodiment 6)

Figure 9:
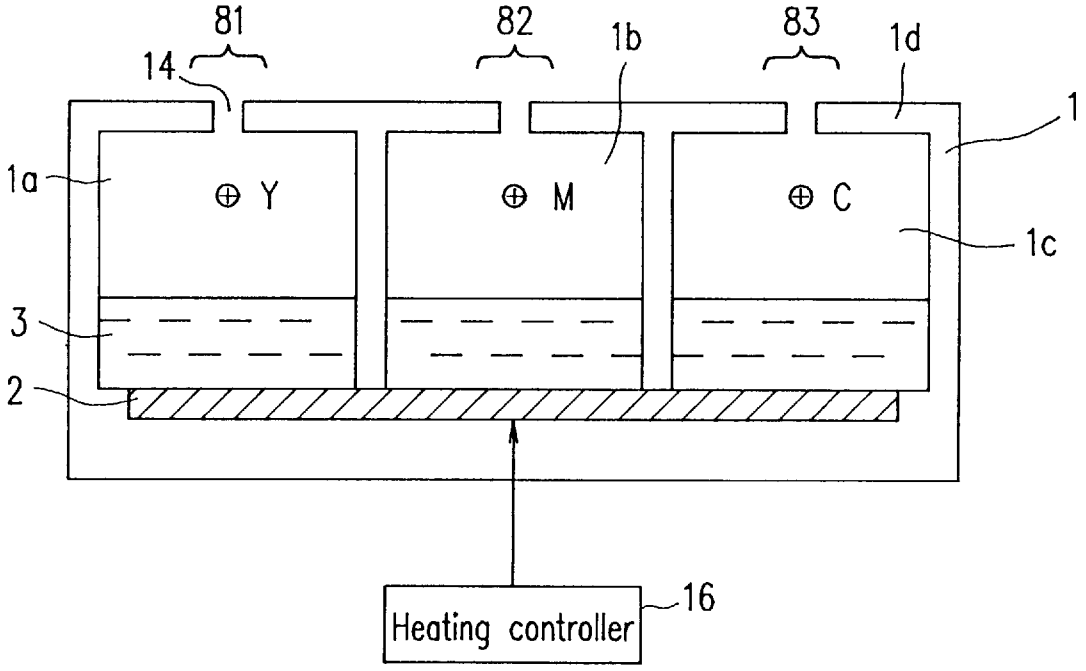
FIG. 9 is a cross-sectional view seen from the front illustrating a main portion of an image printing apparatus of Embodiment 6.
Figure 10:
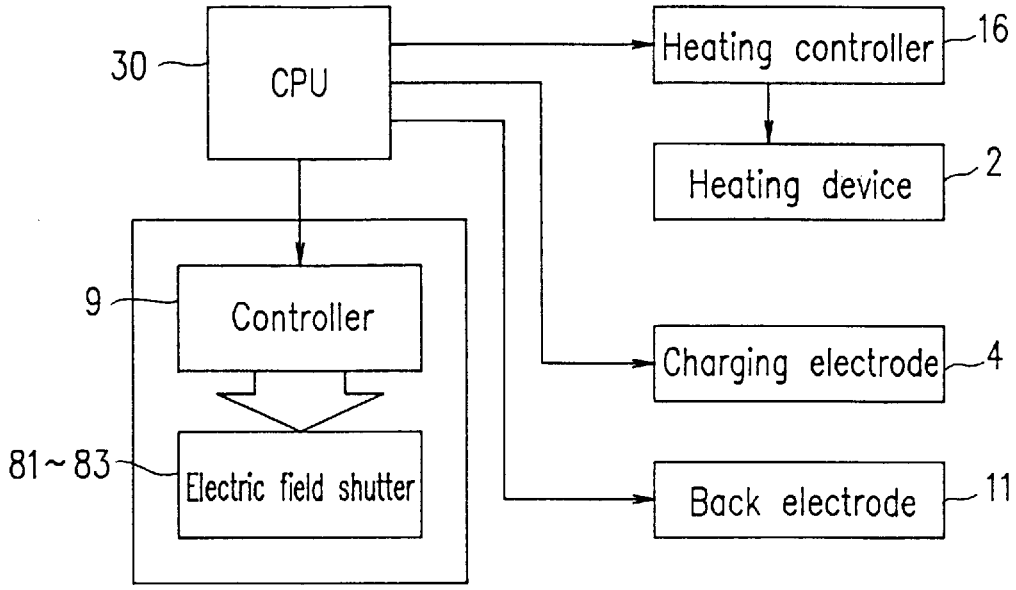
FIG. 10 is a block diagram illustrating a controlling system of the image printing apparatus of Embodiment 6.

FIG. 9 is the cross-sectional view seen from the front illustrating a main portion of an image printing apparatus of the present invention according to Embodiment 6. The printing head 1 of Embodiment 6 includes three ink chambers 1*a*, 1*b* and 1*c* which have the same volume and are mutually and perfectly isolated. An integrated heating device 2 for heating the three ink chambers 1*a*, 1*b* and 1*c* is provided at the lower part of the printing head 1. The heating device 2 is driven by electric power sent from the heating controller 16.

The ink chambers 1*a*, 1*b* and 1*c* contain, for example, sublimating ink of yellow (Y), magenta (M) and cyan (C). Here, examples of various types of the yellow ink 3 include:

anthraisothiazole type,
quinophthalone type,
pyrazolonazo type,
pyridones azo type,
styryl type, etc.

Examples of various types of the magenta ink include:

anthraquinone type,
dicyanoimidazole type,
thiadiazole azo type,
tricyanovinyl type, etc.

Furthermore, examples of various types of the cyan ink include:

azo type, anthraquinone type, naphthoquinone type, indoaniline type, etc.

Each of the ink chambers 1*a*, 1*b* and 1*c* has an ink discharging spout 14 at the central part of the upper wall 1*d* of the printing head 1. Each of the discharging spouts 14 is provided with an electric field shutter 81, 82 and 83, respectively, from left to right in FIG. 9 of the same structure as described above. Therefore, by turning these electric field shutters 81, 82 and 83 ON and OFF, ink of each color is selectively discharged through each discharging spout 14. By combining these various colors of ink on a sheet of paper, a full-color image can be obtained.

Next, operation of the image printing apparatus according to Embodiment 6 will be described with reference to FIGS. 10 and 11A to 11I.

Figures 11A, 11B, 11C, 11D, 11E, 11F, 11G, 11H, 11I:
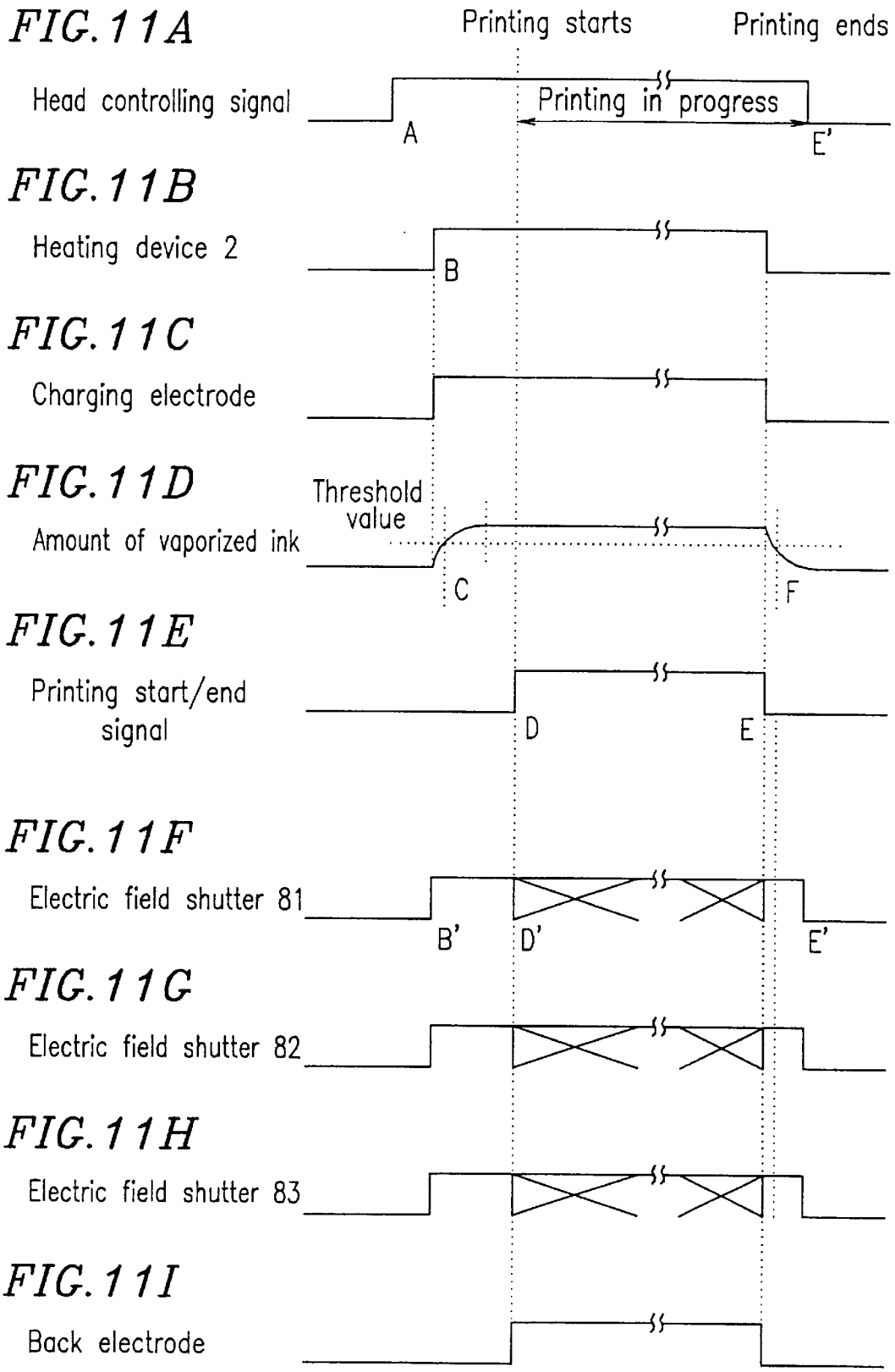
FIGS. 11A to 11I are timing diagrams illustrating the operation of the image printing apparatus of Embodiment 6.

When a head controlling signal having a waveform illustrated in FIG. 11A is transmitted from the CPU 30 to the printing head 1, the heating controller 16 starts driving the heating device 2 at point B (see FIG. 11B) which is a prescribed time after point A, with the rise (point A) of the head controlling signal being a trigger. At this point, the "H" level voltage of about +2 to +5 kV is applied to the charging electrode 4 (see FIG. 11C).

When the heating device 2 is driven, solid or liquid ink 3 in the ink chambers is heated. When the temperature of the ink 3 reaches the sublimation temperature $T_g$ during this heating, gaseous ink 3" is generated. The amount of the gaseous ink 3" increases as time passes, reaching the threshold value at point C (see FIG. 11D). This heating device 2 is controlled in a similar manner as in Embodiment 1 previously described.

When a necessary and sufficient amount of the gaseous ink 3" is generated and the apparatus becomes ready to print (point D in FIG. 11E), a printing start/end signal is output from the CPU 30 to the controller 9 in the discharge controller. With this printing start/end signal being a trigger, the controller 9 requests one line of image data to be transmitted from the image memory (not shown in the figure). This request is made through the CPU 30. In Embodiment 6, the image memory includes color data obtained by breaking the original color image into three colors of Y, M and C, i.e., Y image data, M image data and C image data, which are contained in separate memory regions. These three kinds of color data are simultaneously transmitted to the controller 9.

When, the transmission of the one line of color data is completed, each of the electric field shutters 81, 82 and 83 starts controlling the ONs and OFFs corresponding to each of the color data at point D' in FIG. 11F. In the present embodiment, the electric field shutters 81, 82 and 83 correspond to the Y image data, the M image data and the C image data, respectively. The 500 V voltage is supplied to each of the electric field shutters 81, 82 and 83, and turned ON and OFF in response to the input image data.

Moreover, as illustrated in FIG. 11I, the −1 kV voltage is applied to the back electrode 4 at point D' where each of the electric field shutters 81, 82 and 83 starts switching ON and OFF, and the simultaneous printing of three colors begins. The printing start/end signal is maintained at the "H" level throughout the printing operation (FIG. 11A).

When one line of printing is finished, the next one line of image data is transmitted from the image memory in response to the request made by the controller 9. Then, each of the electric field shutters 81, 82 and 83 is turned ON and OFF in response to the next image data and controls the discharge of the gaseous ink 3" from each of the ink chambers 1*a*, 1*b* and 1*c*, thereby performing the color printing for the second line. The color printing for the remaining lines is performed in a similar manner.

When the printing is finished, the printing start/end signal falls to the "L" level at point E (see FIG. 11E). With this fall being a trigger, the heating device 2, the charging electrode 4 and the back electrode 11 are all turned off (see FIGS. 11B, 11C and 11I).

Also in Embodiment 6, the gaseous ink 3" is not immediately cooled, but remains in the ink chambers 1*a*, 1*b* and 1*c* even if the power supply to the heating device 2 is shut down by the heating controller 16. Therefore, in order to prevent the gaseous ink 3" from leaking, the electric field shutters 81, 82 and 83 are unconditionally turned on for a prescribed time after the printing is finished as previously described in Embodiment 1.

According to the structure of Embodiment 6, the discharge of the gaseous ink 3" of different colors can be simultaneously performed. Therefore, a full-color image can be obtained more easily and in a shorter time than in a method where a plurality of monochromatic images of different colors are printed for each color so that these monochromatic images are overlaid. In the latter method, since only a monochromatic image of one color is formed on the printing medium in one printing operation while the printing head scans the entire printing medium, it takes a plurality of printing operations to obtain a full-color image. In the case of using yellow ink, magenta ink and cyan ink, three printing operations are required in the latter method. On the other hand, a full-color image formation which takes, for example, 120 seconds to be finished in the latter method can be finished in 40 seconds or less in the method of Embodiment 6.

In Embodiment 6, an example of a full-color image printing apparatus which uses yellow ink, magenta ink and cyan ink is described. However, the present invention is not limited thereto. For example, a black ink may be used in addition to the ink of the above three colors. In this case, more excellent black color can be reproduced, thereby improving the printed image quality.

(Embodiment 7)

Figure 12:
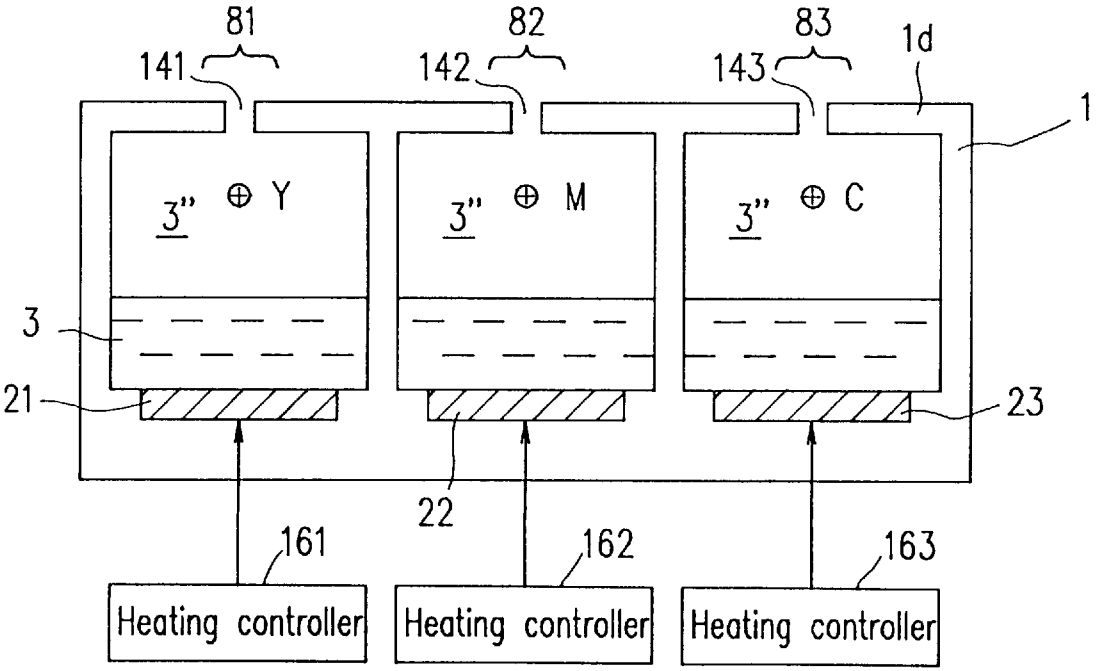
FIG. 12 is a cross-sectional view seen from the front illustrating a main portion of an image printing apparatus of Embodiment 7.

FIG. 12 is the cross-sectional view seen from the front illustrating a main portion of an image printing apparatus of the present invention according to Embodiment 7. Embodiment 7 differs from Embodiment 6 in that heating devices 21, 22 and 23 are provided to the ink chambers 1*a*, 1*b* and 1*c*, respectively, which contain ink 3 for Y, M and C, respectively. Moreover, heating controllers 161, 162 and 163 are connected to the heating devices 21, 22 and 23, respectively, so that the heating of the ink chambers 1*a*, 1*b* and 1*c* is independently controlled.

Operation of this image printing apparatus will be described with reference to FIGS. 13A to 13K. The CPU and other controlling system operate in almost the same manner as in FIGS. 11A to 11I, and the same reference numerals are used to describe corresponding parts.

Figures 13A, 13B, 13C, 13D, 13E, 13F, 13G, 13H, 13I, 13J, 13K:
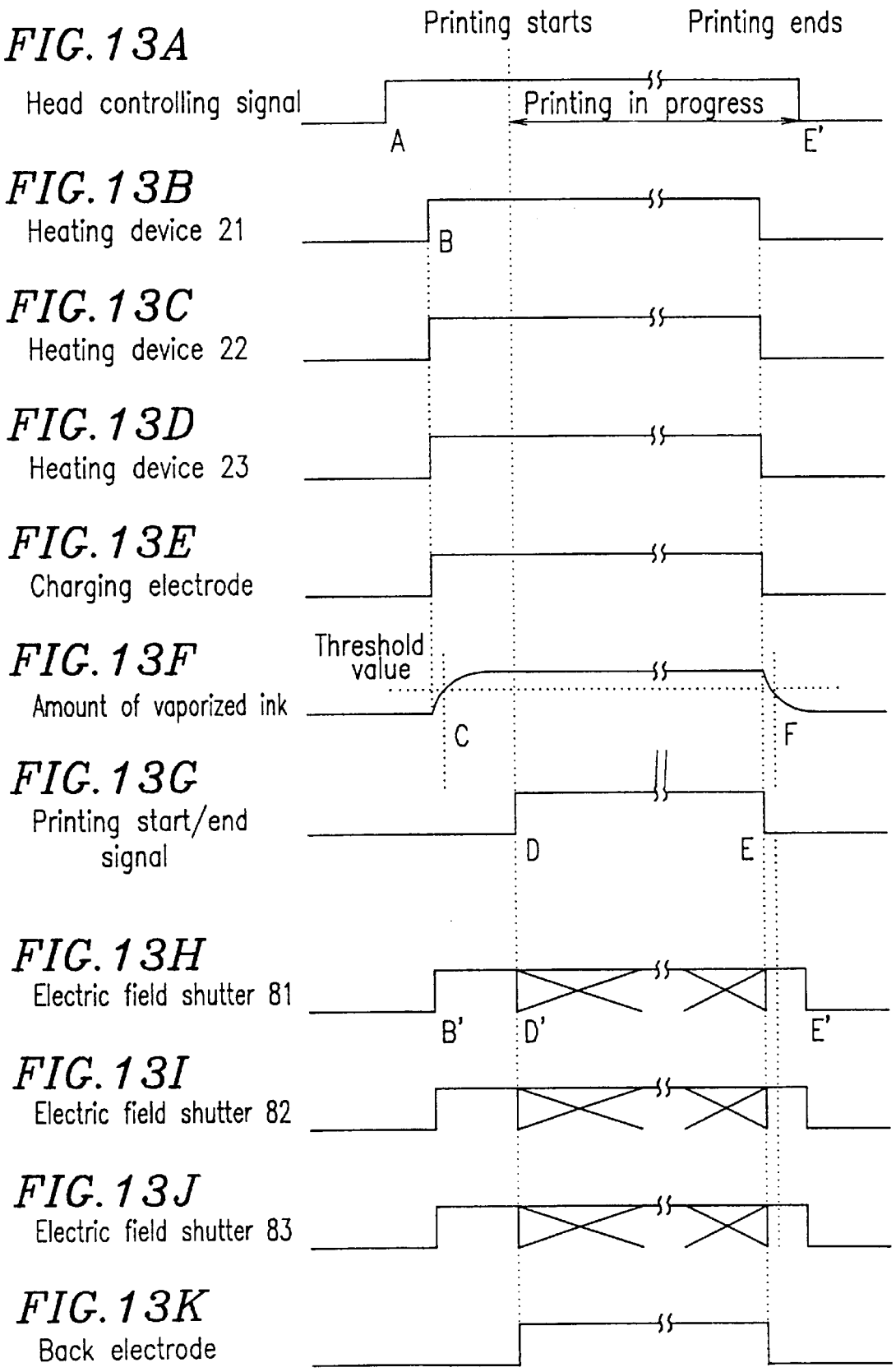
FIGS. 13A to 13K are timing diagrams illustrating the operation of the image printing apparatus of Embodiment 7.

When a head controlling signal having a waveform illustrated in FIG. 13A is transmitted from the CPU 30 to the printing head 1, the heating controller 161, 162 and 163 start driving heating devices 21, 22 and 23, respectively, with the rise of the head controlling signal being a trigger (point A in FIG. 13A), at point B after a prescribed time after point A (see FIGS. 13B, 13C and 13D). At this point, the "H" level voltage of about +2 to +5 kV is applied to the charging electrode 4 (see FIG. 13E).

This heating process sublimates the ink 3 to generate the gaseous ink 3" as in the previous embodiments. Also in Embodiment 7, the heating devices 21, 22 and 23 are controlled in such a manner that the ink is at a prescribed temperature T which is at the ink sublimation temperature $T_g$ or above. A relationship similar to the above-described equation (1) holds between $T_g$ and T.

However, when the sublimation temperature of ink 3 differs for different colors, the sublimation temperature of each ink 3 is set accordingly as in the following equations (2), (3) and (4).

For yellow ink, $$T_Y=T_{gY}+\Delta T_Y \quad (2)$$

For magenta ink, $$T_M=T_{gM}+\Delta T_M \quad (3)$$

For cyan ink, $$T_C=T_{gC}+\Delta T_C \quad (4)$$

In the case where the image printing apparatus uses black ink in addition to the yellow ink, the magenta ink, and the cyan ink, the sublimation temperature of black ink is set accordingly as in the following equation (5).

For black ink, $$T_B=T_{gB}+\Delta T_B \quad (5)$$

When an amount of the gaseous ink 3" increases by the heating and the apparatus becomes ready to print, a printing start/end signal is output from the CPU 30 to the controller 9 of the discharge controller at point D as illustrated in FIG. 13G. Then, the controller 9 requests one line of image data to be transmitted from the image memory with the rise of the printing start/end signal being a trigger. Then, as in the above-described Embodiment 6, Y image data, M image data and C image data are simultaneously transmitted from the image memory, and one line of printing is performed.

Embodiment 7 differs from Embodiment 6 in that the heating devices 21, 22 and 23 are provided in the ink chambers 1*a*, 1*b* and 1*c*, respectively, and are independently controlled for heating by the heating controllers 161, 162 and 163, respectively. Therefore, the following effect can be obtained.

Since the content of color data differs for different colors, a consumption amount of various ink colors differ from time to time. However, according to Embodiment 7 where the heating devices 21, 22 and 23 are independently controlled for heating in response to color data, the amount of gaseous ink 3" in each of the ink chambers 1*a*, 1*b* and 1*c* can be constantly maintained without being affected by the contents of other color data. As a result, the short supply or the excessive supply of gaseous ink 3" of a specific color does not occur.

As described above, according to Embodiment 7, the most appropriate amount of the gaseous ink 3" of each color can be discharged without being affected by the difference in the sublimation temperature or in the contents of the image data for different colors.

(Embodiment 8)

Figure 14:
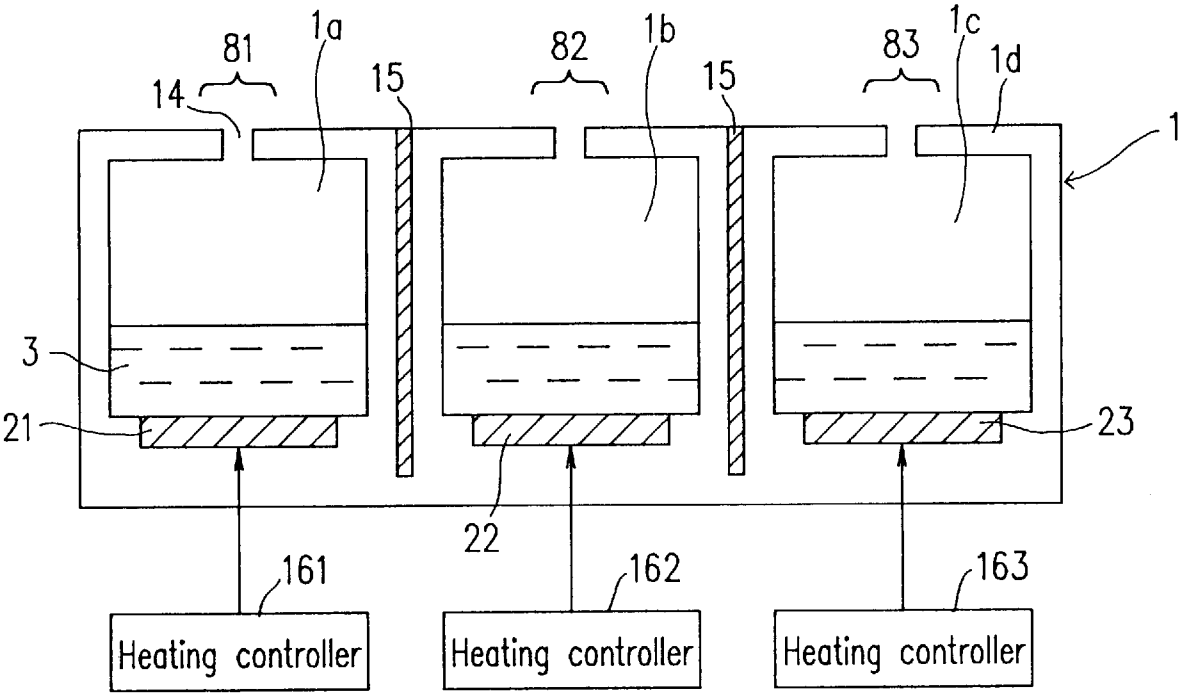
FIG. 14 is a cross-sectional view seen from the front illustrating a main portion of an image printing apparatus of Embodiment 8.

FIG. 14 is the cross-sectional view seen from the front illustrating a main portion of an image printing apparatus of the present invention according to Embodiment 8. In FIG. 14, the same components shown in FIG. 12 are designated by the same reference numerals and the detailed description thereof is omitted. Embodiment 8 is the same as Embodiment 7 except that the ink chambers 1*a*, 1*b* and 1*c* containing the ink 3 of Y, M and C colors, respectively, are thermally insulated by thermal insulators 15. According to Embodiment 8, the effect of Embodiment 3 can be obtained in addition to the effect of the above-described Embodiment 7.

(Embodiment 9)

Figure 15:
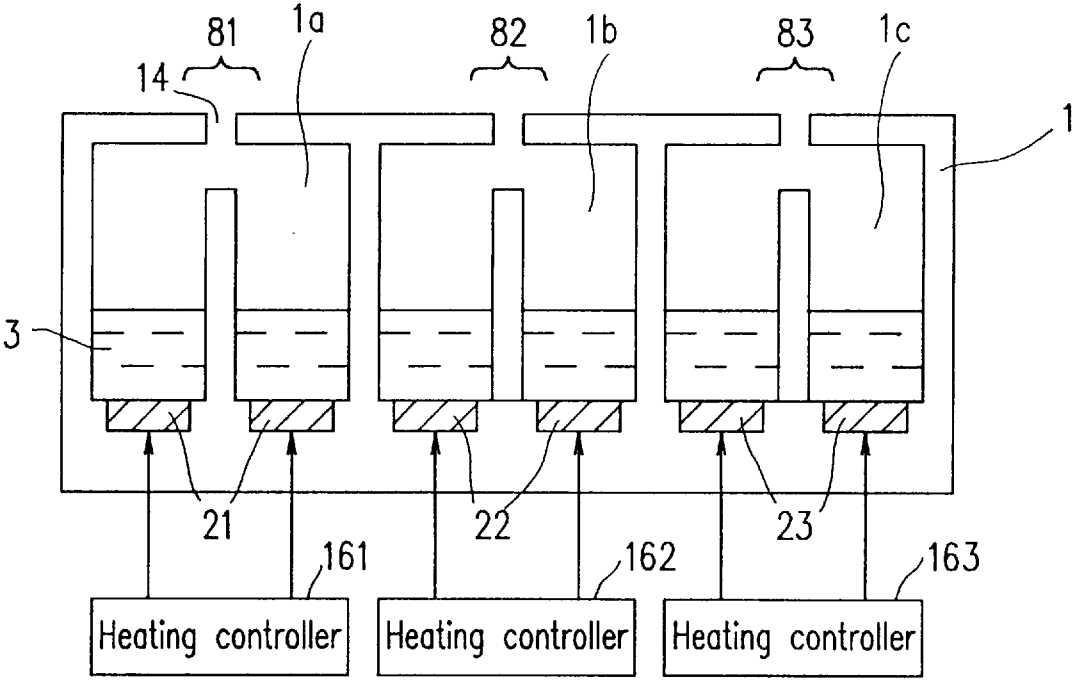
FIG. 15 is a cross-sectional view seen from the front illustrating a main portion of an image printing apparatus of Embodiment 9.

FIG. 15 is the cross-sectional view seen from the front illustrating a main portion of an image printing apparatus of the present invention according to Embodiment 9. In FIG. 15, the same components shown in FIGS. 12 and 14 are designated by the same reference numerals and the detailed description thereof is omitted. In Embodiment 9, the image printing apparatus is obtained by combining the structure of Embodiment 1 illustrated in FIG. 1 to that of Embodiment 6 illustrated in FIG. 9. That is, each of the ink chambers 1*a*, 1*b* and 1*c* containing the ink 3 of Y, M and C colors, respectively, is further divided in two so that a sublimation time for the ink 3 is shortened by the reduction in the ink volume and a warm up time is thereby shortened. Heating devices 21 which were divided in two are provided to the ink chamber 1*a* which was divided in two, respectively. Similarly, heating devices 22 which were divided in two are provided to the ink chamber 1*b* which were divided in two and heating devices 23 which were divided in two are provided to the ink chamber 1*c* which were divided in two.

(Embodiment 10)

Figure 16:
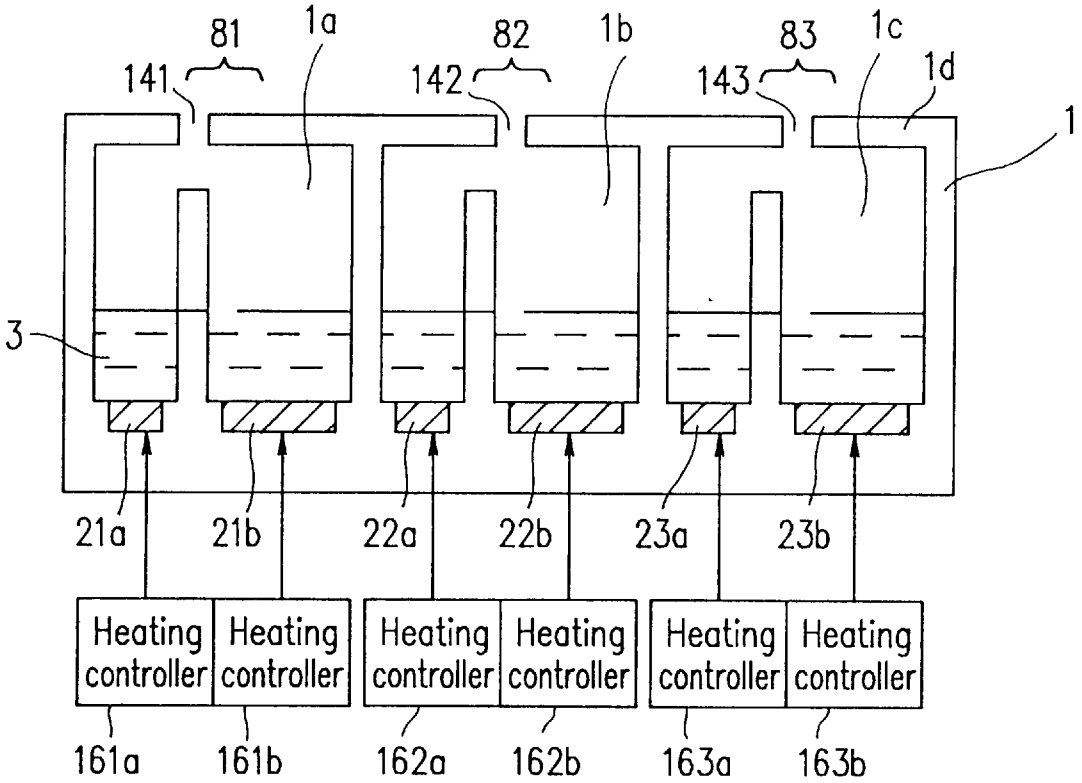
FIG. 16 is a cross-sectional view seen from the front illustrating a main portion of an image printing apparatus of Embodiment 10.

FIG. 16 is the cross-sectional view seen from the front illustrating a main portion of an image printing apparatus of the present invention according to Embodiment 10. In FIG. 16, the same components shown in FIGS. 12 to 15 are designated by the same reference numerals and the detailed description thereof is omitted. In Embodiment 10, the image printing apparatus is obtained by changing the volume of each of the ink chambers 1*a*, 1*b* and 1*c* in Embodiment 9, which were divided in two. That is, the first ink chamber on the left has a smaller volume than the second ink chamber on the right. For each ink chamber, the heating controller 161*a*, 161*b*, 162*a*, 162*b*, 163*a* and 163*b* is provided so as to heat the ink in the corresponding ink chamber independently of the other ink chamber.

(Other embodiments)

For example, in the embodiments illustrated in FIGS. 15 and 16, each of the ink chambers 1*a*, 1*b* and 1*c* which is divided in two can be thermally insulated by a thermal insulator. Other alterations and combinations of the above-described embodiments are possible.

In the above embodiments, the case where solid ink is accommodated in each ink chamber is described. Alternatively, liquid ink may be accommodated in each ink chamber. In this case, the liquid ink is also heated to vaporize, and the gaseous ink obtained by the vaporization is discharged.

As described above in detail, according to the image printing apparatus of the present invention, the discharge of the gaseous ink can be intermittently controlled. Therefore, only an amount of ink necessary for printing can be discharged. As a result, the ink is not wasted and the running cost can be reduced. Moreover, devices for recovering the unused portion of the gaseous ink and for cleaning the area proximate to the electric field shutter are not required. The miniaturization of apparatus is, therefore, possible.

In addition, according to the image printing apparatus, the ink chamber is divided into a plurality of sub-chambers. As a result, the thermal capacity of each ink chamber can be reduced.

In particular, according to the image printing apparatus, since each ink chamber is mutually and independently controlled for heating, a necessary and sufficient amount of gaseous ink can be generated in response to an image signal. Therefore, the short supply or the excessive supply of the gaseous ink does not occur and the most appropriate amount of gaseous ink can always be supplied. As a result, an image quality can be enhanced, and the running cost can be further reduced.

In particular, according to the image printing apparatus, since the ink chamber to be heated can be efficiently heated, the warm up time can be further shortened. Moreover, the image printing apparatus requires less electric power.

In particular, according to the image printing apparatus, the volumes of the ink chambers are different. Therefore, by heating the ink chamber of smaller volume, a necessary amount of gaseous ink can be obtained much faster. As a result, the warm up time can be further shortened.

In particular, according to the image printing apparatus, since the unused portion of gaseous ink which is not discharged and remains in the ink chamber can be recovered for reuse in the ink chamber of smaller volume, the ink can be conserved. Therefore, the running cost can be further reduced in this regard.

In particular, according to the image printing apparatus, an image printing apparatus which can form a full-color image in a short time can be realized.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image printing apparatus comprising:

a printing head including an upper part with an inner wall, wherein at least two ink chambers are provided in an interior part of the printing head bounded by at least said inner wall, said ink chamber includes a first ink chamber having an upper part and a second ink chamber having a larger volume than that of said first ink chamber, the second ink chamber including an upper part, and wherein the inner wall of the upper part of the printing head is an incline descending from the upper part of the second ink chamber to the upper part of the first ink chamber.

2. An image printing apparatus for forming an image on a printing medium, comprising:

a printing head including a first ink chamber and a second ink chamber each ink chamber for accommodating different ink therein, and a discharge spout associated with both the first ink chamber and the second ink chamber;

a heater for independently heating the ink in the first ink chamber and the second ink chamber to make the ink gaseous; and a discharging section for discharging the gaseous ink from the first ink chamber and the second ink chamber to the printing medium through the discharge spout.

3. An image printing apparatus according to claim 2, further comprising a discharge controlling section for controlling the discharging section such that the gaseous ink is discharged intermittently through the discharge spout.

4. An image printing apparatus according to claim 3, wherein the discharge controlling section comprises a shutter located on a top surface of the printing head adjacent the discharge spout.

5. An image printing apparatus according to claim 4, wherein the discharging section comprises:

a charging electrode provided between the printing medium and first ink chamber and the second ink chamber; and a back electrode provided on a side of the printing medium which is opposite a side on which the image is formed.

6. An image printing apparatus according to claim 5, further comprising a controller for controlling the shutter, the heater, and the charging electrode.

7. An image printing apparatus according to claim 2, wherein the first ink chamber and the second ink chamber have substantially a same volume, and wherein the discharge spout is positioned at a central portion of a top surface of the printing head.

8. An image printing apparatus according to claim 2, wherein the printing head is formed of a member having high thermal conductivity and the first ink chamber and the second ink chamber are thermally insulated by a thermal insulator disposed therebetween.

9. An image printing apparatus according to claim 2, wherein the second ink chamber has a volume larger than that of the first ink chamber.

10. An image printing apparatus according to claim 9, wherein the printing head includes an upper part with an inner wall, the first ink chamber and the second ink chamber being defined in part by the inner wall, and wherein the inner wall is declined so as to descend from the second ink chamber to the first ink chamber.

11. An image printing apparatus according to claim 2, wherein the heater is operative to heat the ink at a temperature lower than a temperature where the ink becomes gaseous, when printing is not performed.

12. An image printing apparatus for forming an image on a printing medium, comprising:

a printing head including a plurality of printing head portions, each of the printing head portions including a top outer surface, each of the printing head portions comprising an ink chamber for accommodating ink therein and a discharge spout associated with the ink chamber;

a plurality of shutters, each of the plurality of shutters being provided for a corresponding printing head portion of the plurality of printing head portions and located on the top outer surface of the corresponding printing head portion adjacent the discharge spout;

a heater for heating ink in the ink chamber of the plurality of printing head portions;

a plurality of charging electrodes, each of the plurality of charging electrodes being provided for the corresponding printing head portion and located inside of the printing head;

a plurality of back electrodes, each of the plurality of back electrodes being provided for the corresponding printing head portion and provided on a side of the printing medium which is opposite a side on which the image is formed; and a controller for controlling the plurality of shutters, the heater and the plurality of charging electrodes.

13. An image printing apparatus according to claim 12, wherein the ink chambers included in the plurality of printing head portions are isolated from one another and have substantially a same volume.

14. An image printing apparatus according to claim 12, wherein the heater independently heats each of the plurality of ink chambers included in the plurality of printing head portions.

15. An image printing apparatus according to claim 12, wherein the printing head is formed of a member having high thermal conductivity and any two of the ink chambers adjacent to each other are thermally insulated by a thermal insulator disposed therebetween.

16. An image printing apparatus according to claim 12, wherein the heater is operative to heat the ink at a temperature lower than a temperature where the ink becomes gaseous, when the printing is not performed.

17. An image printing apparatus according to claim 12, wherein the ink chambers include at least three ink chambers which accommodate at least three colors of ink, and wherein the heater includes at least three heaters provided for the respective at least three ink chambers, the at least three heaters being controlled independently in accordance with color data for the at least three colors.

18. An image printing apparatus for forming an image on a printing medium, comprising:

a printing head, having a top outer surface, including two ink chambers and a shutter, the shutter including at least two distinct portions located at the outer top surface of the printing head on opposite sides of a discharge spout of the printing head;

a heater provided under and in thermal communication with the two ink chambers;

a charging electrode provided between the printing medium and the two ink chambers and located within the printing head;

a back electrode provided on a side of the printing medium which is opposite a side on which the image is formed;

a controller associated with the shutter, the heater and the charging electrode;

wherein the distinct portions include a common electrode located on one side of the spout and a control electrode located on a second side of the spout opposite the common electrode.

19. An image printing apparatus for forming an image on a printing medium according to claim 18, wherein there is a plurality of spouts and one common electrode and a control electrode for each one of the spouts.

20. An image printing apparatus for forming an image on a printing medium according to claim 18, wherein there is a single spout.

21. An image printing apparatus for forming an image on a printing medium according to claim 20, wherein the single spout has a slit shape.

* * * * *